US005782395A

United States Patent [19]

Sauer

[11] Patent Number: 5,782,395

[45] Date of Patent: Jul. 21, 1998

[54] DRIVING TOOL FOR FASTENER ELEMENTS

[75] Inventor: Marcus Sauer, Bad Schwartau, Germany

[73] Assignee: Joh. Friedrich Behrens AG, Ahrensberg, Germany

[21] Appl. No.: 650,471

[22] Filed: May 20, 1996

[30] Foreign Application Priority Data

May 24, 1995 [DE] Germany ..... 295 08 658 U

[51] Int. Cl.[6] ..... B25C 1/04

[52] U.S. Cl. ..... 227/130

[58] Field of Search ..... 227/130, 8

[56] References Cited

U.S. PATENT DOCUMENTS

| | | | |
|---|---|---|---|
| 2,914,032 | 11/1959 | Powers et al. | 121/13 |
| 3,011,169 | 12/1961 | Cast et al. | 1/44.1 |
| 3,086,207 | 4/1963 | Lingle et al. | 1/44.4 |
| 3,181,566 | 5/1965 | Volkmann et al. | 137/625.6 |
| 3,320,860 | 5/1967 | Bade | 91/461 |
| 3,612,379 | 10/1971 | Panock | 227/8 |
| 3,677,457 | 7/1972 | Ramspeck et al. | 227/8 |
| 3,784,077 | 1/1974 | Burke, Jr. et al. | 227/8 |
| 3,948,426 | 4/1976 | La Pointe | 227/8 |
| 4,351,464 | 9/1982 | Fehrs et al. | 227/7 |
| 4,378,084 | 3/1983 | Scala | 227/8 |
| 4,441,644 | 4/1984 | Farian | 173/139 |
| 4,597,517 | 7/1986 | Wagdy | 227/8 |
| 4,609,135 | 9/1986 | Elliesen | 227/130 |
| 4,629,106 | 12/1986 | Howard et al. | 227/8 |
| 4,867,366 | 9/1989 | Kleinholz | 227/66 |
| 4,932,480 | 6/1990 | Golsch | 173/139 |
| 5,020,712 | 6/1991 | Monacelli | 227/8 |
| 5,025,971 | 6/1991 | Schafer et al. | 227/156 |
| 5,137,197 | 8/1992 | Bauer | 227/8 |
| 5,193,730 | 3/1993 | Tanaka et al. | 227/8 |
| 5,485,946 | 1/1996 | Jankel | 227/130 |
| 5,495,973 | 3/1996 | Ishizawa et al. | 227/130 |

FOREIGN PATENT DOCUMENTS

| | | |
|---|---|---|
| 0 326 639 | 7/1992 | European Pat. Off. . |
| 2 661 353 A1 | 10/1991 | France . |
| 78 18 775 | 10/1978 | Germany . |
| 30 21 884 | 1/1981 | Germany . |
| 26 018 36 | 6/1981 | Germany . |
| 33 38 750 A1 | 4/1984 | Germany . |
| 27 37 327 C2 | 9/1987 | Germany . |
| 37 03 753 | 8/1988 | Germany . |
| 88 10 753.1 | 10/1988 | Germany . |

*Primary Examiner*—Scott A. Smith

*Attorney, Agent, or Firm*—Vidas, Arrett & Steinkraus, P.A.

[57] ABSTRACT

The invention relates to a driving tool for fastener elements, wherein a tool casing includes a valve cavity of a main valve closed by a casing cover, a valve piston being sealingly and slidingly mounted coaxially within the valve cavity about a work cylinder, the valve piston when in a lower position sealingly engaging upon an upper edge of the work cylinder so as to close an inlet passage communicating with a pressure air source and opening into an upper work space of the work cylinder, and the valve piston when in an upper position closing an outlet passage, which communicates with the work space via a throughbore of the valve piston, by sealingly engaging a valve seat element, the valve piston having a lower work surface which is continuously subjected to pressure of the pressure air source, and an upper work surface adapted to be selectively subjected to atmospheric pressure or pressure of the pressure air source by a control valve, the improvement of which is characterized by the valve piston having axially extending throughbores, interconnecting webs extending through the throughbores, and the interconnecting webs having one end connected to a sealing ring at the bottom of the valve piston and having an other end connected to a damper ring at the top of the valve piston.

15 Claims, 2 Drawing Sheets

DRIVING TOOL FOR FASTENER ELEMENTS

BACKGROUND OF THE INVENTION

The present invention relates to a driving tool for fastener elements as defined in the introductory portion of claim 1, namely a driving tool for fasteners wherein a tool casing includes a valve cavity of a main valve closed by a casing cover, a valve piston sealingly and slidingly mounted coaxially within said valve cavity about a work cylinder, the valve piston, when in a lower position, sealingly engaging upon an upper edge of the work cylinder so as to close an inlet passage communicating with a pressure air source and opening into an upper work space of said work cylinder, and the valve piston, when in an upper position, closing an outlet passage which communicates with said work space via a throughbore of said valve piston, by sealingly engaging a valve seat element, the valve piston having a lower work surface which is continuously subjected to pressure of said pressure air source and an upper work surface adapted to be selectively subjected to atmospheric pressure or pressure of said pressure air source by means of control valve.

Driving tools of this type include a nose portion having an ejecting channel through which a fastener element can be ejected. The ejecting channel is supplied with fastener elements from a laterally positioned magazine. A driving plunger reciprocates transversely with respect to the supply opening, with said plunger ejecting a fastener element from the nose portion when it moves in the ejecting direction. The plunger is secured to a work piston which is slideably arranged in a work cylinder. A cylinder chamber atop the piston is filled with compressed air when the piston performs a driving operation. The chamber is vented for returning the piston to its initial position. In addition, a cylinder chamber below the work piston may be filled with compressed air for returning the piston.

There are provided valve means to control air in the upper work space of the piston. For smaller tool sizes so-called "parallel valves" are known, which valves are arranged in parallel to the work piston and are directly associated to a triggering switch. To this end the valve piston has its bottom sealingly engage upon the upper edge of the cylinder. When the valve piston is in an upper position, it closes an outlet passage which communicates with the work space via a throughbore of the valve piston. To this end the valve piston may be provided with a hollow cylindrical piston extension including said bore, which extension is slidingly guided in a sleeve and sealingly engages a valve seat element when the piston is in the upper position. At the same time the sleeve may serve as an abutment for the top of the valve piston about said hollow cylindrical piston extension.

In order to move the valve piston between the lower and upper positions, the valve piston is provided with a lower work surface which is continuously subjected to pressure air by the pressure air source. Furthermore, it has an upper work surface adapted to be selectively subjected to atmospheric pressure or pressure of the pressure air source by means of a control valve. The control valve may be positioned adjacent the valve piston and may be actuated by a trigger via a valve rod extending through the housing. The control valve may be positioned directly adjacent the trigger and may communicate with the main valve via a relatively long control passage.

The valve piston of plastics may engage directly upon the upper edge of the cylinder when it is in its lower position. However, even minimal damages of the sealing surface may result in leakages. Furthermore, such valve pistons are shaped by wear so that replacement thereof for servicing may also result in leakages. This is why the valve piston usually is provided with a resilient seal at its bottom. Also a resilient element is mounted quite often to the top of the valve piston in order to dampen engagement of an abutment such as the above-mentioned sleeve.

It has become known to provide the valve piston at the top and at the bottom with cut-ins for receiving O-sealing rings and, respectively, O-damper rings. Making the cut-ins is generally expensive. Furthermore, the mounting of the hard O-rings requires substantial expenditure. Nevertheless, there is a certain risk that they drop from their grooves under certain operative conditions whereby the tool may be damaged or even become inoperative.

SUMMARY OF THE INVENTION

In view of the above, it is a primary object of the present invention to improve a driving tool of the above defined type so as to enhance sealing of the valve piston with respect to the work cylinder and/or dampening of impects with respect to an upper abutment.

The invention achieving this object is defined in claim 1, namely a driving tool for fasteners as previously described having an improvement wherein the valve piston has axially extending throughbores, interconnecting webs extending through said throughbores, the interconnecting webs having one end connected to a sealing ring at the bottom of the valve piston and having the other end connected to a damper ring at the top of the valve piston. Preferred embodiments and further developments of the invention are defined in the subclaims.

In the driving tool of the present invention the integral or positive connection of the sealing ring and/or the damper ring to the valve piston improves its sealing and dampening characteristics and accordingly reliability of the tool. Furthermore, the integral or positive connection allows to reduce the expendi-ture for making the valve piston and for positioning the sealing and damper rings. The integral or positive connection is ensured by interconnecting webs which extend through axial throughbores of the valve piston and which have one end connected to the sealing ring and its other end connected to the damper ring. The ring material may provide the interconnecting webs. Furthermore the sealing ring, the damper ring, and the interconnecting webs may be injection molded onto the valve piston; in particular thermoplastic elastomeric materials may be used as injection material. This is so because thermoplastic elastomeric materials show the processing characteristics of thermoplastics and when hardened the resiliency of elastomers. Principally, however, other soft and resilient materials may be used for the sealing and/or damper rings, for example POM. Preferably, the ring material is injection molded onto one side of the damper ring so as not to damage the sealing of the work cylinder.

BRIEF DESCRIPTION OF THE DRAWINGS

Further details and advantages of the present invention may be seen from the following description of an embodiment shown in the accompanying drawings. In the drawings.

DETAILED DESCRIPTION OF THE INVENTION

Figure 1:
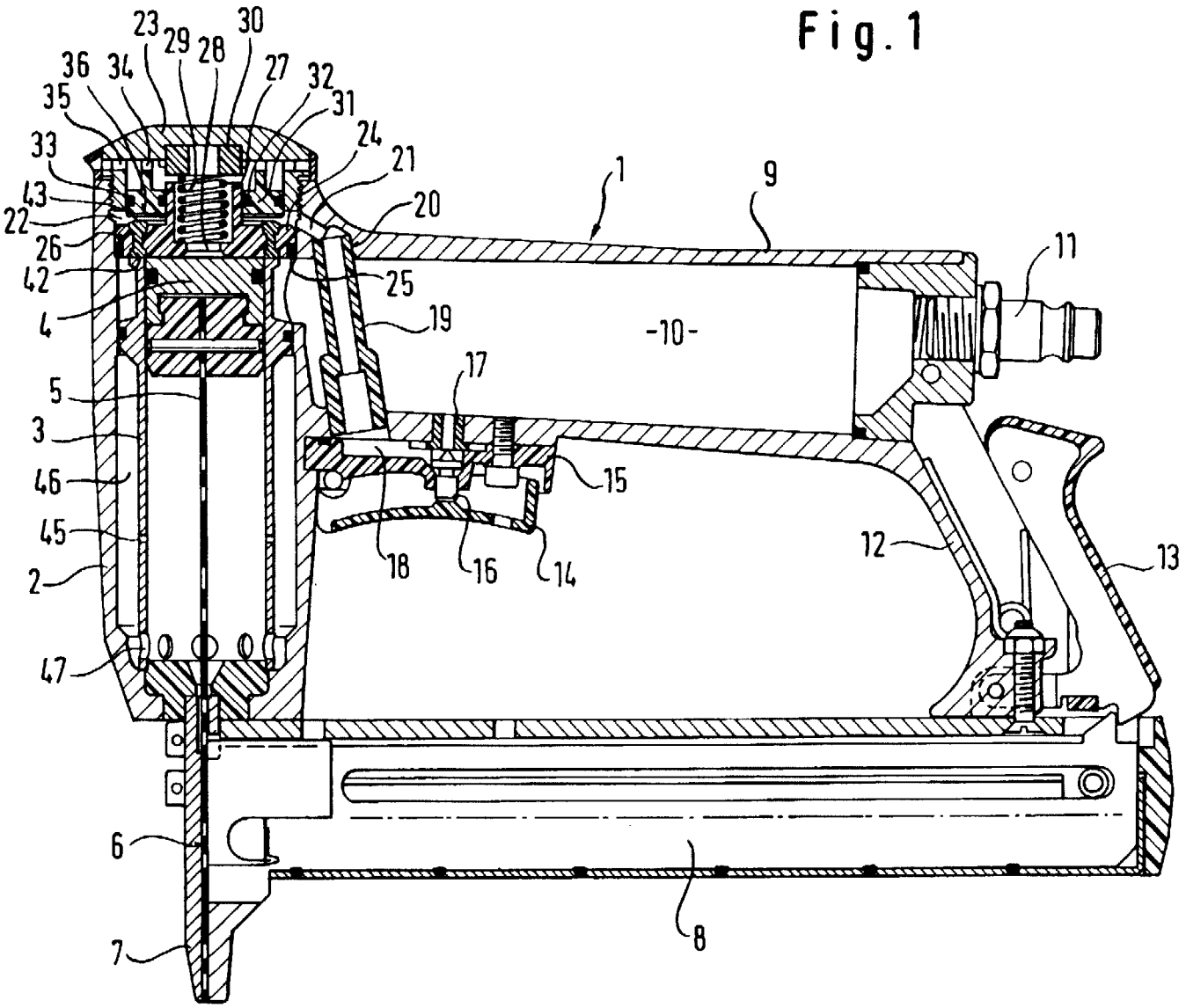
FIG. 1 shows a longitudinal section of the driving tool.

The driving tool as shown in FIG. 1 includes a casing 1 which includes, within a casing head 2, a work cylinder 3 wherein a work piston 4 is positioned. The work piston 4 is connected to a drive plunger 5 which is guided in an ejection channel 6 of a nose portion 7. Laterally mounted to the nose portion 7 is a linear magazine 8 for fastener elements, which magazine communicates with the ejection channel 6 via a supply opening.

Furthermore, the casing 1 has a handle 9 which contains a pressure air reservoir 10 adapted to communicate to a pressure air source via a tube fitting 11. At its rear end handle 9 is connected to the magazine 8 via a bridge 12. Thereat is provided a closure lever 13 which serves to open and close a magazine 8 for the loading of fastener elements.

At the bottom of the handle 9 a trigger lever 14 is mounted to a control valve support 15 adjacent the casing head 2. The control valve support 15 houses a switch pin 16 which makes contact with a cylindrical portion of the trigger lever 14 and has a conical portion concentrically aligned with a sealing sleeve 17 in casing 1, communicating with the pressure air reservoir 10. In the position as shown the switch pin 16 has its conical portion in a position to open the through-passage of the sealing sleeve 17 so that a cavity 18 provided in the control valve support 15 communicates with the pressure air reservoir. When the trigger lever 14 is actuated by being pivoted upwards, the conical portion is displaced into the opening of the sleeve 17 so that the above-mentioned communication is interrupted. At the same time an O-ring seal (not shown) positioned in a groove between the conical and cylindrical portions is removed from a sealing seat of the control valve support 15, and a flow passage between the cavity 18 and the ambient is opened in the area of the cylindrical portion 16.

The cavity 16 communicates with a control passage which includes a tube 19 extending through the pressure air reservoir 10 and provided in a blind bore 20 at the bottom of the casing. The control passage comprises a flow passage 21 communicating with blind bore 20, which passage 21 opens into a valve space 22 situated above the work cylinder and disposed above a casing cover 23.

The valve space 22 receives a valve piston 24 which carries at its periphery an O-ring seal 25. Valve piston 24 has an external step 26 for supporting the O-ring at its inner periphery and at its upper side. The valve piston 24 is provided at its top with a hollow cylindrical piston extension 27. Furthermore it includes a central throughbore 28 which extends through piston extension 27. In its upper area the throughbore 28 has an enlargement receiving a coil spring 29. Coil spring 29 is supported against the bottom of a valve se at element 30 which is retained in a blind bore of the casing cover 23.

Piston extension 27 is externally guided in a sleeve 31 which carries an O-ring seal 32 for being internally sealed with respect to the piston extension. Externally sleeve 31 is sealed via a further O-ring seal 33 with respect to the interior wall of a threaded plug which retains the casing cover 23 within the casing. At its upper side, sleeve 31 is supported against the bottom of the casing cover 23. Thereat it is provided with radial outflow grooves 34. They communicate with radial outflow grooves 35 of the casing cover 23 which communicate with the ambient.

Sleeve 31 is provided at its bottom with radially extending ribs (not shown) at 36.

Figure 2:
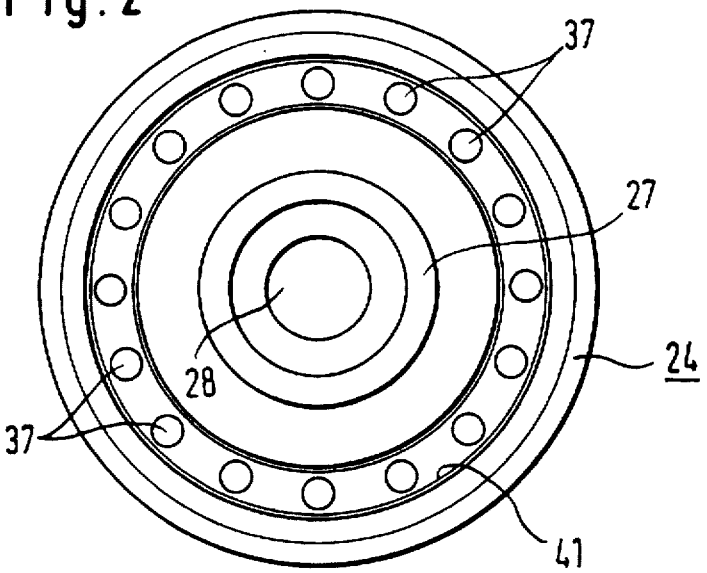
FIG. 2 shows an elevation of the valve piston of the driving tool in an enlarged scale.
Figure 3:
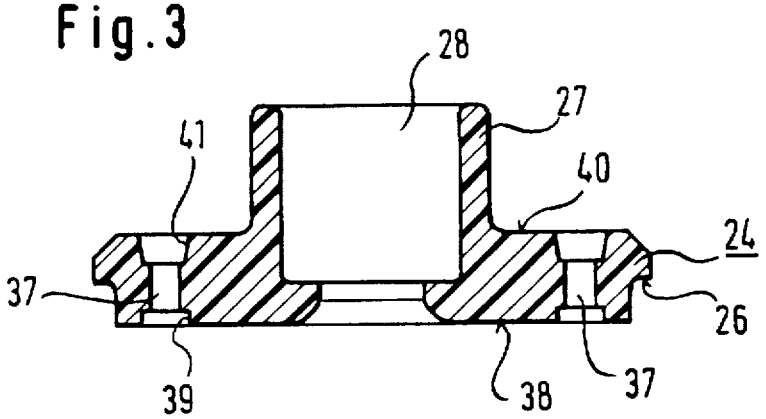
FIG. 3 a cross-section of the valve piston of FIG. 2 in an enlarged scale.

As may be seen more clearly in FIGS. 2 and 3, valve piston 24 includes axial throughbores 37 which are positioned concentrically to its center axis externally about the piston extension 27. The axial throughbores open at the bottom 38 of the valve piston 24 into a continuous annular groove 39 of rectangular cross-section. They open at the top 40 of the valve piston 24 into a continuous annular groove 41 of trapezoidal cross-section which is enlarged towards the top 40.

Figure 4:
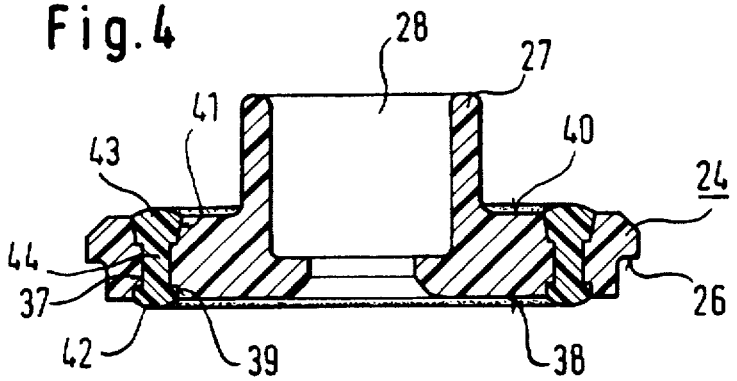
FIG. 4 a cross-section of the valve piston with the sealing and damper rings in an enlarged scale.

As shown in FIG. 4, the throughbores 37 as well as the grooves 39, 41 are filled with a resilient sealing and dampening material to provide a sealing ring 42 and a damper ring 43 with interconnecting webs 44 in the throughbores 37, which sealing and damper rings spherically extend beyond the bottom 38 and the top 40.

Valve piston 24 is injection molded from a plastic material. This may be a hard or impact resistent material such as a POM. The piston is to be made sufficiently rigid in order to resist the occuring pressures and permanently to support the spring. The injection molded tool is divided along the plane of the external step 26. The sealing and dampening material is injection molded onto the finished valve piston 24. For example, a thermoplastic elastomer can be used. Injection molding about the valve piston may be performed after it has been positioned in a further tool. Preferably, the location where injection molded is initiated is at the top 40.

As may be seen in FIG. 1, the sealing ring 42 formed in this manner is associated to the upper edge of the work cylinder 3 which forms a counter-sealing surface. The damper ring 43, however, cooperates with ribs 36 at the bottom of sleeve 31.

The work cylinder 3 communicates with the return air chamber 46 surrounding it along approximately a third of its height via radial bores 45. Chamber 46 communicates further with the interior of the work cylinder at its lower end via radial bores 47.

The tool operates as follows: In the initial condition as shown in FIG. 1 a pressure air reservoir 10 communicates with valve space 22 via cavity 18, tube 20 and flow passage 21. Pressure air also pressurizes the top of valve piston 24. Furthermore it pressurizes the bottom of valve piston 24 in the area extending beyond the work cylinder 3. Since the pressure acting upon the upper work surface of the valve piston 24 as assisted by coil spring 29 exeeds the pressure acting upon the lower work surface, the valve piston along with sealing ring 42 is sealingly urged against the upper edge of work cylinder 3. The work space above work piston 4 communicates with the ambient via throughbore 28 of valve piston 24 and radial outflow grooves 24, 35 so as to be vented thereby.

Actuation of trigger lever 14 communicates cavity 18 and valve space 22 to atmosphere. As a result pressure air acts upon only the lower work surface of valve piston 24 so that the latter is displaced against the action of coil spring 29 into its upper opening position which is defined by damper ring 43 engaging radial ribs 36 of sleeve 31. As a result, upward movement of the piston is dampened. When the valve piston 24 is in its upper position, it has the upper edge of piston extension 27 sealingly engage valve seat element 30. As a result, communication of work space to atmosphere is interrupted. At the same time upward movement of valve piston 24 enables pressure air flow from pressure air reservoir 10 via the upper edge of work cylinder 3 into the work space so that work piston 4 is instantaneously driven downwards. As a result a fastener element loaded by drive plunger 5 from magazine 8 is ejected through nose portion 7.

When trigger lever 14 has been released, the latter returns to its initial position as shown in FIG. 1. As a result, the upper work surface of valve piston 24 is again subjected to pressure air. The cavity between the ribs 36 at the bottom of sleeve 31 provides for flow of pressure air to piston extension 27. As a result valve piston 24 returns to its lower closing position as shown wherein sealing ring 42 sealingly engages the upper edge of cylinder 3. As a result, communication between the pressure air reservoir 10 and the work space is interrupted and the latter is again communicated with atmosphere. When the piston is in its lower position, pressure air has flown through radial bores 45 into return air chamber 46. Return air passes through further radial bores 47 into the work space below the work piston 4 vented at its top and returns the latter into its initial position as shown in FIG. 1.

Thereafter a further driving operation may be initiated by actuation of trigger 14.

I claim:

1. A driving tool for fastener elements, wherein a tool casing (1) includes a valve cavity (22) of a main valve closed by a casing cover (23), a valve piston (24) having a top end and a bottom end, and being sealingly and slidingly mounted coaxially within said valve cavity about a work cylinder (3), said valve piston (24) when in a lower position sealingly engaging upon an upper edge of the work cylinder (3) so as to close an inlet passage communicating with a pressure air source and opening into an upper work space of said work cylinder, and said valve piston (24) when in an upper position closing an outlet passage, which communicates with said work space via a throughbore (28) of said valve piston, by sealingly engaging a valve seat element (30), said valve piston (24) having a lower work surface which is continuously subjected to pressure of said pressure air source, and an upper work surface adapted to be selectively subjected to atmospheric pressure or pressure of said pressure air source by means of a control valve (15,16,17), the improvement of which is characterized by said valve piston (24) having axially extending throughbores (37), interconnecting webs (44) extending through said throughbores (37), and said interconnecting webs (44) having one end connected to a sealing ring (42) at the bottom (38) of said valve piston (24) and having an other end connected to a damper ring (43) at the top (40) of said valve piston (24).

2. The driving tool of claim 1, wherein one of said sealing ring (42) and said damper ring (43) extend slightly beyond an end of said valve piston (24).

3. The driving tool of claim 1, wherein said throughbores (37) diverge towards an end of said valve piston (24).

4. The driving tool of claim 1, wherein one of said sealing ring (42) and said damper ring (43) cover only a fraction of an end (40) of said valve piston (24).

5. The driving tool of claim 1, wherein said valve piston (24) has supporting shoulders (39,41) at an end of said valve piston laterally of said sealing ring (42) and said damper ring (43).

6. The driving tool of claim 5, wherein the supporting shoulders are spaced apart and the spacing between said shoulders (39,41) increases towards an end (40) of said valve piston (24).

7. The driving tool of claim 5, wherein said shoulders (39,41) define lateral boundaries of an annular groove (39, 41) in a end of said valve piston (24).

8. The driving tool of claim 1, wherein said sealing ring (42), said damper ring (43), and said interconnecting webs (44) are injection molded onto said valve piston (24).

9. The driving tool of claim 8, wherein one of said sealing ring (42) and said damper ring (43) are injection molded to the top (40) of said valve piston (24).

10. The driving tool of claim 1, wherein said sealing ring (42), said damper ring (43) and said interconnecting webs (44) are made of the same material.

11. The driving tool of claim 10, wherein said sealing ring (42), said damper ring (43) and said interconnecting webs (44) are made of a thermoplastic elastomeric material.

12. The driving tool of claim 1, wherein said valve piston (24) has at its top a hollow cylindrical piston extension (27) through which said throughbore (28) of said valve piston extends, said piston extension sealingly and slidingly being guided in a sleeve (31) and sealingly engaging said valve seat element (24) when in the upper position, and said sleeve (31) providing an abutment for said damper ring (43) of said valve piston (24).

13. The driving tool of claim 12, wherein said abutment (31) for said damper ring (43) of said valve piston (24) is provided with radial ribs (36).

14. The driving tool of claim 1, wherein said valve piston (24) supports an O-ring seal (25).

15. The driving tool of claim 14, wherein said valve piston (24) has an external step (26) for supporting said O-ring seal (25).

* * * * *

UNITED STATES PATENT AND TRADEMARK OFFICE
CERTIFICATE OF CORRECTION

PATENT NO. : 5,782,395

DATED : July 21, 1998

INVENTOR(S) : MARCUS SAUER

It is certified that error appears in the above-identified patent and that said Letters Patent is hereby corrected as shown below:

Col. 6, line 8, after "end" delete "(40)";

Col. 6, line 14, after "end" delete "(40)";

Col. 6, line 18, after "in" delete "a" and insert -- an --.

Signed and Sealed this

Sixth Day of October, 1998

Bruce Lehman

*Attest:*

BRUCE LEHMAN

*Attesting Officer*

*Commissioner of Patents and Trademarks*